US006434756B1

(12) United States Patent
Hoop

(10) Patent No.: US 6,434,756 B1
(45) Date of Patent: Aug. 20, 2002

(54) NECK AND SPINE PROTECTION APPARATUS

(76) Inventor: Vohn Hoop, 550 Arey Rd., Pebbles, OH (US) 45660

( * ) Notice: Subject to any disclaimer, the term of this patent is extended or adjusted under 35 U.S.C. 154(b) by 0 days.

(21) Appl. No.: 09/773,309

(22) Filed: Jan. 31, 2001

(51) Int. Cl.[7] ..... A63B 71/10
(52) U.S. Cl. ..... 2/425; 2/462; 2/468
(58) Field of Search ..... 2/425, 459, 461, 2/463, 467, 421, 468, 44, 92, 909

(56) References Cited

U.S. PATENT DOCUMENTS

| | | | | |
|---|---|---|---|---|
| 3,134,106 | A | * | 5/1964 | Shaffer et al. |
| 3,514,784 | A | * | 6/1970 | McDavid |
| 3,879,761 | A | * | 4/1975 | Bothwell |
| 4,338,685 | A | * | 7/1982 | LaPorta, Jr. |
| 4,599,752 | A | * | 7/1986 | Mitchell |
| 4,999,855 | A | * | 3/1991 | Brown |
| 5,101,517 | A | * | 4/1992 | Douglas |
| 5,123,408 | A | | 6/1992 | Gaines |
| 5,313,670 | A | | 5/1994 | Archer, III |
| 5,353,437 | A | | 10/1994 | Fiels et al. |
| 5,517,699 | A | | 5/1996 | Abraham, II |
| 5,546,601 | A | | 8/1996 | Abeyta |
| 5,581,816 | A | | 12/1996 | Davis |
| 5,715,541 | A | | 2/1998 | Landau |
| 5,724,681 | A | * | 3/1998 | Sykes |
| 6,052,835 | A | * | 4/2000 | O'Shea |
| RE36,691 | E | * | 5/2000 | Pinsen |

FOREIGN PATENT DOCUMENTS

| | | | |
|---|---|---|---|
| JP | 6-166906 | * | 6/1994 |

* cited by examiner

*Primary Examiner*—Rodney M. Lindsey
(74) *Attorney, Agent, or Firm*—Dinsmore & Shohl LLP

(57) ABSTRACT

An apparatus for protecting the neck and spine of a user are provided. A neck and spinal protection apparatus is provided comprising a chest cover for fitting about a chest of a user. Moreover, a back cover fits about an upper back of the user and a shoulder cover fits about the user's shoulders and is connected to the chest and back cover. Furthermore, a head cover fits over a head of the user and is connected to the back cover. The head cover extends only about the upward and rearward periphery of a user and disperses a force associated with an impact to the head cover downward to the chest, back and shoulder covers in use.

20 Claims, 5 Drawing Sheets

NECK AND SPINE PROTECTION APPARATUS

FIELD OF THE INVENTION

The present invention relates generally to devices which protect the neck and spine of a user during participation in contact sports, such as by way of example only, football, motorcycle racing, car racing, and the like.

BACKGROUND OF THE INVENTION

Injuries to the neck and spine of users engaged in sporting activities, such as by way of example only football, can be severe. In fact, each year high school football players are fatally injured or paralyzed as a result of trauma to their neck and spine. These injuries continue to occur even though protective head and shoulder equipment are worn by the players. Moreover, football is not the only sporting activity wherein severe trauma to the neck and spine occur, as each year numerous bicyclists and motorcyclists are paralyzed or killed participating in their activities.

These injuries are often caused by hyperextension compression of the neck, axial loading of the neck, hyperflexion of the neck, and the like. The structural integrity of an individual's vertebrae are compromised during these types of injuries, resulting in neural dysfunction and possible death. Helmets are often worn by individuals engaged in high risk sporting activities to minimize the risk of injury.

However, padded helmets only shield the head from direct impact and provide no protection to the neck when a force is applied to the back, front, or side of the head. Moreover, when an individual violently hits the ground the neck is tossed about and when an individual lands or is hit directly on his/her head, compression occurs to the neck, helmets alone do not mitigate these types of injuries to the neck and spine.

Compression of the head is a major problem with football players. For example, consider a tackler who lowers and straightens his head before ramming it into his opponent. Upon impact the head of the tackler is compressed into tackler's body, and as the head of the tackler stops on impact, the body of the tackler continues to move forward after the initial impact thereby compressing the neck and spine of the tackler. This compression is not alleviated with typical football helmets, and the tackler's spine buckles during the compression resulting in potentially severe spinal damage to the tackler.

Many attempts have been made to address this problem, such as with the creation of neck rolls or other types of pads which are inserted between the helmet and shoulder pads of a football player. Yet, these devices do not assist with compression of the head and neck into the spine, rather, these devices assist with preventing violent side-to-side movements of the head, alleviating to some degree whiplash type injuries.

Further, devices have been developed which replace existing helmets, or require substantial modification to existing helmets. These devices are cumbersome, expensive, and intrusive on the football players attempting to use them. Some devices require a single bar to collect and disperse an impact force to the neck and spine to other parts of the body. Furthermore, the field of vision of a football player is often restricted in other devices previously provided, and the weight of the helmet which must be worn by the football player becomes an unreasonable burden which restricts and hampers the normal movement of the football player during use. Additionally, some previously provided devices have new structures which are themselves subject to rupture or damage during impact and which may present additional injuries to a user.

Accordingly, a need still exists for an effective apparatus to protect the neck and spine of a user by more effectively dispersing forces associated with an impact to the head of a user downward to the upper back and chest regions of the user. Moreover, this need exists not only for football players, but for all individuals engaged in sporting activities where injuries to the neck and spine occur.

SUMMARY OF THE INVENTION

Accordingly, an object of the invention is to provide apparatus for protecting the neck and spine of a user. A head cover made of lightweight material which can withstand a substantial impact, such as by way of example only fiberglass, polycarbonate lexan, and the like, is placed over a protective helmet worn by a user during a sporting activity. The lower portion of the head cover is affixed to an upper back cover and shoulder cover of the user. A chest cover is also connected to the shoulder cover. The upper back, shoulder, and chest covers are operable to fit over any protective shoulder equipment which may be worn by the user.

Moreover, the shoulder cover fits above the shoulders of the user creating a gap between the user's shoulders and the lower edge of the shoulder cover. Upon impact to the head cover, the user's head is restricted in its range of motion and the force associated with the impact is channeled and dispersed to the up per back, shoulder, and chest covers preventing any serious injuries to the user's neck and spine as a result of the impact.

Additional objectives, advantages and novel features of the invention will be set forth in the description that follows and, in part, will become apparent to those skilled in the art upon examining or practicing the invention. The objects and advantages of the invention may be realized and obtained by means of the instrumentalities and combinations particularly pointed out in the appended claims. To achieve the foregoing and other objects and in accordance with the purpose of the present invention, apparatus for protecting the neck and spine of a user are provided.

One aspect of the present invention, provides an apparatus for protecting the neck and spine of a user wherein a chest cover is provided for fitting about a chest of the user. Further, a back cover fits about an upper back of the user and a shoulder cove r is connected to the chest and back covers and fits about the user's shoulders. Moreover, a head cover fits over a head of the user and is connected to the shoulder and back covers. Further, the head cover is operable to disperse a force associated with an impact to the head cover and disperse the force downward to the chest, back, and shoulder covers.

Another aspect of the present invention, provides an apparatus for protecting the neck and spine of a user including an upper torso cover operable to fit about a chest, an upper back, and shoulders of the user. Also, a neck and head cover is provided which is operable to fit about a rear portion of the user's neck and head and attached to the upper torso cover. Moreover, the neck and head cover is operable to disperse a force to the head or neck of the user downwardly to the upper torso cover.

In yet another aspect of the present invention, an apparatus for protecting the neck and spine of user is provided having a right breast, shoulder, and upper back plate operable to be fitted about the user's right breast, shoulder and upper back. Further, a left breast, shoulder, and upper back plate is provided and operable to be fitted about the user's left breast, shoulder, and upper back. Finally, a head plate is provided which is operable to be fitted about the user's head and securely fastened to the right and left plates.

Still other aspects of the present invention will become apparent to those skilled in the art from the following description of an exemplary embodiment, which is by way of illustration, one of the best modes contemplated for carrying out the invention. As will be realized, the invention is capable of other different and obvious aspects, all without departing from the invention. Accordingly, the drawings and descriptions are illustrative in nature and not restrictive.

BRIEF DESCRIPTION OF THE DRAWINGS

The accompanying drawings, incorporated in and forming part of the specification, illustrate several aspects of the present invention and, together with their descriptions, serve to explain the principles of the invention. In the drawings.

DETAILED DESCRIPTION

The present invention provides apparatus for protecting the neck and spine of a user. The apparatus presented herein are depicted as being worn by a user while engaged in sporting activities such as, football, motorcycle racing, car racing, and the like. Although, as one skilled in the art will readily appreciate the apparatus may be used for a variety of additional activities where a user wishes to avoid a potentially fatal neck or spine injury, such as equestrian activities, normal automobile driving, bicycling, skating, skiing, and others.

Moreover, the materials which may be used to make the apparatus are well known to those in the art. Preferably, the material is lightweight and hard such as fiberglass or polycarbonate lexan. In this way, the user will not notice any significant weight by wearing the apparatus and the apparatus will withstand an impact that may occur to the user's head. Further, the exact dimensions of the devices are readily obtainable by those skilled in the art and customizable depending upon the desired fit of the user. By way of example only, consider a neck and spine protection apparatus attached to the shoulder pads of an average high school football player. In this instance, the rear of the apparatus may extend for 18 inches while the front extends for 14 to 18 inches. Moreover, the width of the apparatus may extend for 11 inches.

Figure 1:
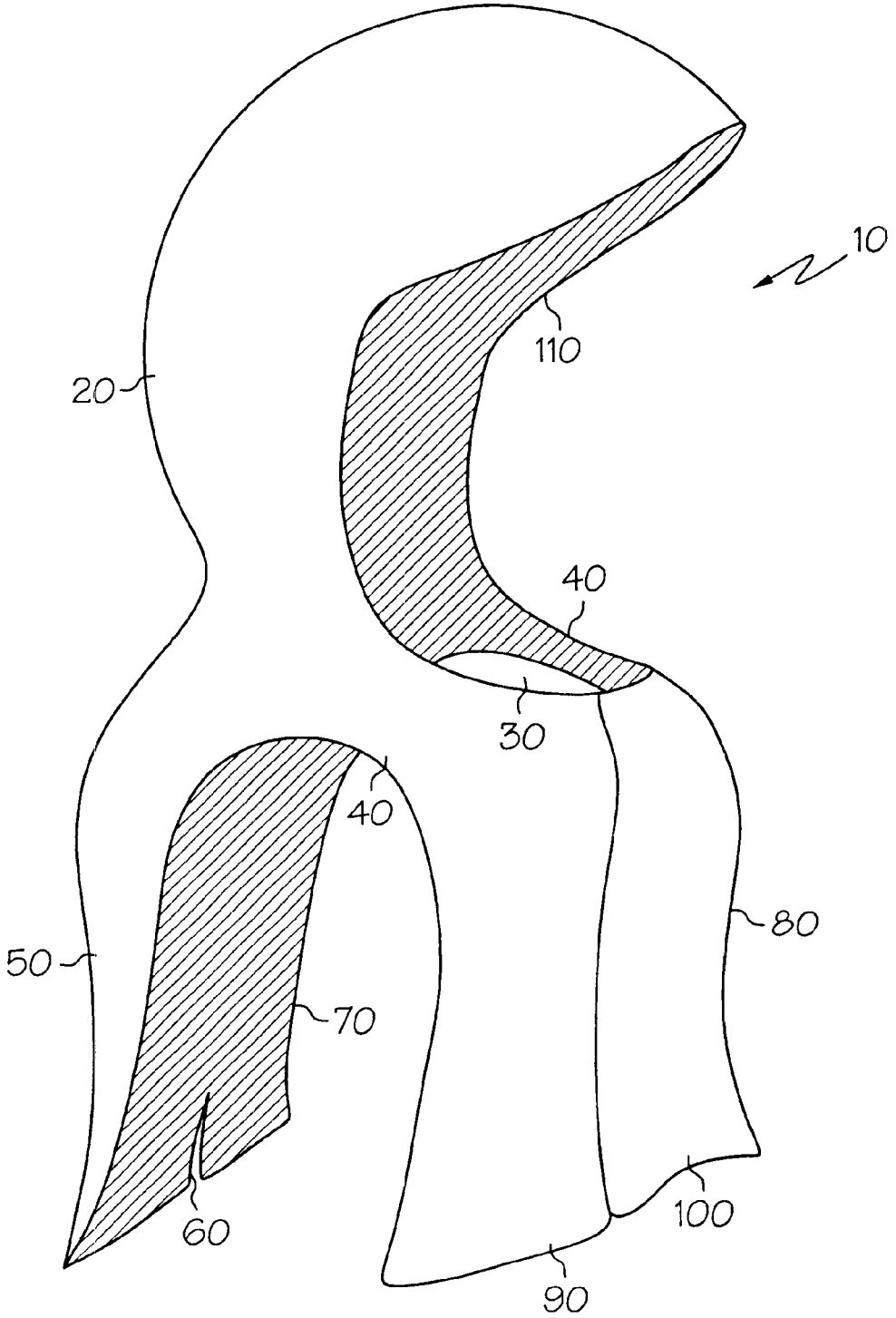
FIG. 1 depicts a neck and spine protection apparatus of the present invention.

FIG. 1 depicts a neck and spine protection apparatus of the present invention. The protection apparatus 10 is depicted as a single apparatus, although as one skilled in the art will readily appreciate, this apparatus may be segmented into one or more component parts which fasten to one another to form the apparatus 10 of FIG. 1, such as component parts depicted in FIG. 5.

Opening 30 provides an insertion area for a user's head, such that shoulder panels 40 rest over the shoulders of the user. Further, the shoulder panels 40 are fitted to rest slightly above the shoulders of the user, providing a gap between the shoulder panels and the shoulders of the user. As one skilled in the art will readily appreciate the gap resting above the center of the user's shoulders reduces stress on the collar bone of the user upon impact. Also, the shoulder panels may be fitted to be placed over protective shoulder equipment worn by the user such as and by way of example only, shoulder pads worn by a football player.

Back panel 50 may be a single panel or separated into two panels such as right back panel 60 and left back panel 70. The Back panel is connected to the head panel 20 and the shoulder panels 40 the back panel is operative to fit over the upper back of the user. Further, as one skilled in the art will readily appreciate any impact to the head panel will disperse the impact's force downwardly to the back panel 50, as well as shoulder panels 40 and front panel 80. By dispersing the force associated with an impact to the head panel 20, the user is less likely to experience a trauma to the spine and neck, especially when an impact creates a compressive force onto the neck and spine.

Similarly, front panel 80 may be a single panel, or two separate panels including a right panel 90 and a left panel 100. If the apparatus 10 includes two separate panels as part of its front panel 80, then these panels (e.g., 90 and 100) may be operable to be fastened to each other, or alternatively these panels (e.g., 90 and 100) may be not be fastened together at all, and there may be a large space existing between the two panels (not shown in FIG. 1).

The apparatus 10 of FIG. 1 includes an inner portion 110 of head plate 20, which is operable to be placed over any protective head gear worn by a user, such as a helmet. Moreover, the dimensions of head plate 20 is operable to not restrict the normal field of vision of the user wearing apparatus 10. In this way, head plate 20 may cover a user's helmet, without attaching to the helmet of the user, and the user continues to enjoy full range of head motion and field of vision.

Optionally, head plate 20 may snap to a user's helmet (not shown in FIG. 1) at the top most point of the user's helmet. However, even if head plate 20 snaps, or is otherwise fastened to the user's helmet, the fastening should still provide the user with the ability to move his/her head, such that the snap provides circular movement of the user's helmet, while remaining fastened to the user's helmet.

Figure 6:
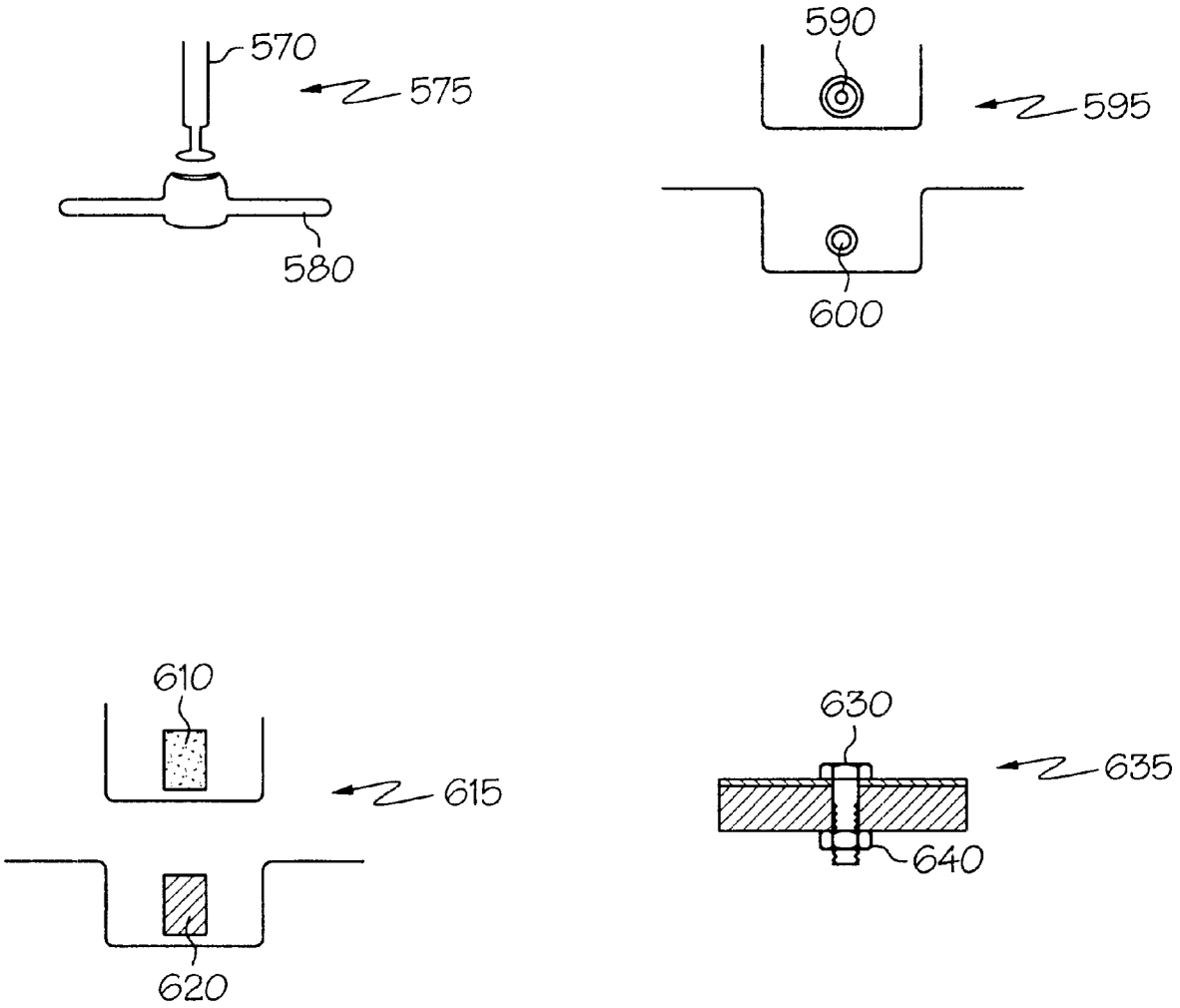
FIG. 6 depicts various attachment devices associated with a neck and spine protection apparatus.

Apparatus 10, may also be securely fastened to a user's protective shoulder equipment, in a variety or ways. Consider for purposes of illustration only, FIG. 6 which depicts various attachment devices associated with a neck and spine protection apparatus, such as the apparatus 10 of FIG. 1.

A slip loop fastening device 575 may be deployed, where a locking base 580 resides on the protective shoulder equipment of the user and permits a male post 570 to be inserted into the base 580 and securely locked by twisting post 570 or by moving post 570 to one end of base 580. This slip lop fastening device is well known by those skilled in the art and may take on a variety of variations all of which are intended to be included as part of the present invention.

A second fastening device 595 may be deployed as a simple snap device where a male end 590 may reside on either the apparatus 10 or the protective shoulder equipment of the user. Opposite the male end, a female end 600 would reside operable to permit the male end 590 to be inserted and locked into the female end 600.

A third fastening device 615, made of adhesive material (e.g. 610 and 620) similar to VELCRO®, may be affixed to both the apparatus 10 and the protective shoulder equipment. When the material is placed in contact with itself, the material securely fastens the apparatus 10 and the protective shoulder equipment to one another.

A fourth fastening device 635 may be constructed as a screw 630 which is inserted through the apparatus 10 and through the protective shoulder equipment. Next a bolt 640 is placed over the end of the screw on the underside of the protective shoulder equipment and twisted onto the screw 630 to securely fasten the apparatus 10 to the protective shoulder equipment.

Further, as one skilled in the art will readily appreciate, there may be no fastening required at all between the apparatus 10 and the protective shoulder equipment of the user. Or, alternatively, such as and by way of example only, the protective shoulder equipment of the user and the apparatus 10 of FIG. 1 may be one device integrated together for purposes of manufacturing and distribution.

Figure 2:
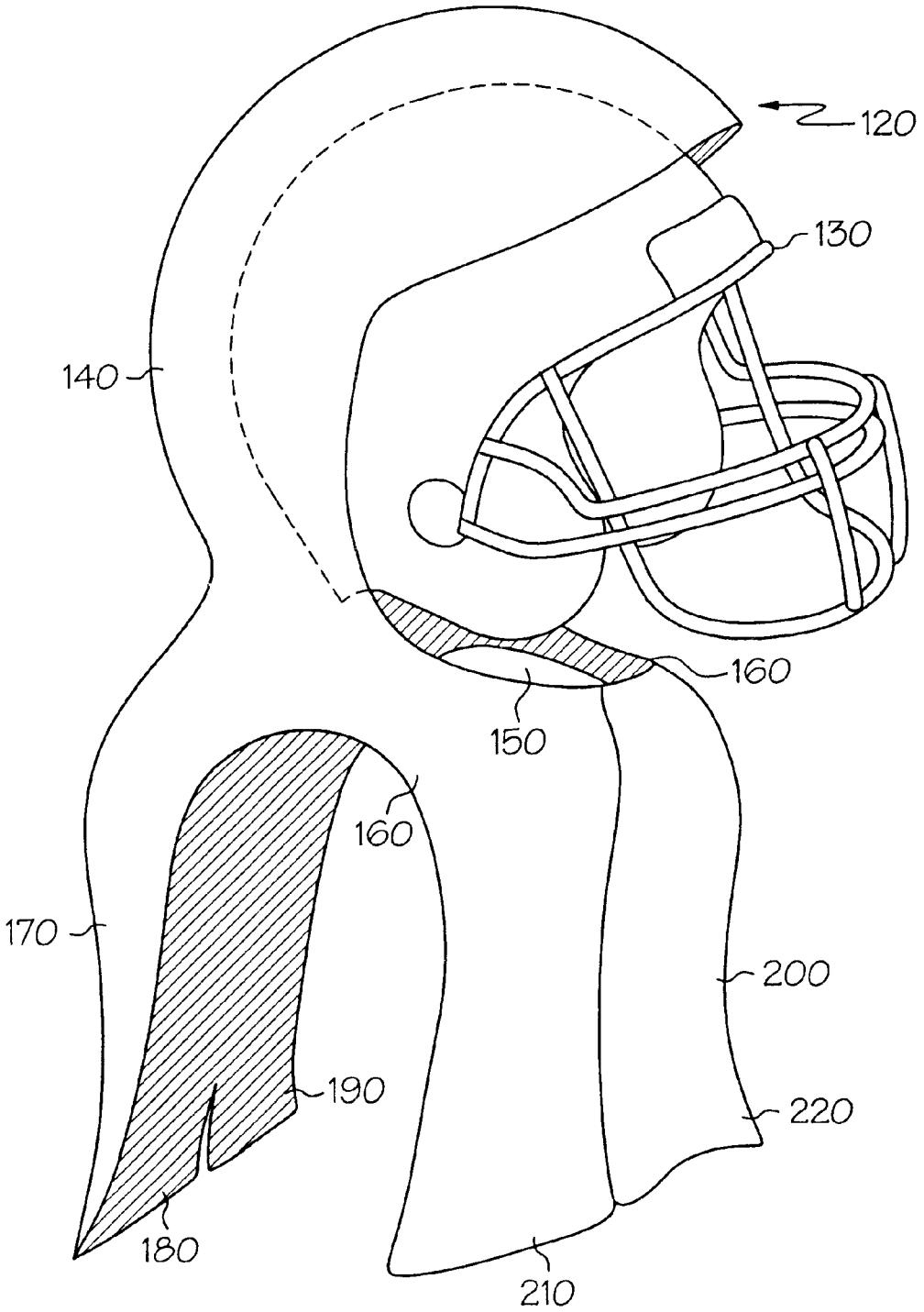
FIG. 2 depicts a neck and spine protection apparatus fitted about protective head equipment of a user.

FIG. 2 depicts a neck and spine protection apparatus fitted about protective head equipment of a user. Apparatus 120 of FIG. 2 more clearly illustrates how a helmet 130 worn by a user may easily fit within the apparatus 120, such that the head of the user and the helmet may freely move within the apparatus 120. Although not depicted in FIG. 2, a gap between the interior of the head plate 140 of the apparatus 120 and user's helmet 130 permits the helmet to move unobstructed within the apparatus 120.

Moreover, a user's neck is inserted through gap 150 in apparatus 120. Further, a right front breast plate 210 and left front breast plate 220 may be separated such that a user may slip the apparatus 120 over his/her head, neck and shoulders. The breast plates (210 and 220) combine to form a chest plate 200 of apparatus 120. Shoulder plates 160 connect the chest plate 200 to the upper back plate 170. The upper back plate 170 may be further subdivided into a right 180 and left 190 upper back plate which is connected to the head plate 140 and the shoulder plates 160 of the apparatus 120.

Although, FIG. 2 depicts a football/hockey helmet 130 as being enclosed by head plate 140, one skilled in the art will readily appreciate that any helmet worn by a user may be used with apparatus 120 such as and by way of example only a bicycle helmet, a hockey helmet, a motorcycle helmet, and the like. Moreover, no helmet may be required at all in situations where limited head trauma is expected. Or, alternatively the apparatus 120 may be manufactured and shipped as one unit with the helmet worn by the user, or as an attachable unit to the helmet.

Additionally, head plate 140 may be equipped with an air bag similar to air bags deployed in automobiles. The air bag may be discharged by using a carbon dioxide cartridge, and the like. Moreover, discharge of the air bag may occur upon impact to the head plate 140 and restored to a pre-discharged state by the user by pressing an appropriate button on the head plate 140 which would deflate and restore the air bag within the head plate 140. In this way, the user may experience an enhanced neck, head, and spine protection with the air bag deployment of head plate 140.

Further, apparatus 120 is operable to disperse a force associated with an impact to the head plate 140 downwardly to the shoulder plates 160, the chest plate 200, and the upper back plate 170. In this way, compressive forces which might otherwise produce fatal or severely debilitative injuries to the user's neck and spine are avoided or substantially mitigated.

Figure 3:
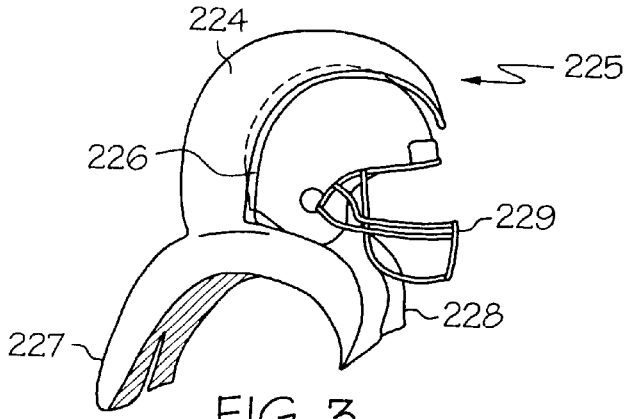
FIG. 3 depicts a side view of a neck and spine protection apparatus fitted about protective head equipment of a user.

FIG. 3 depicts a side view of a neck and spine protection apparatus fitted about protective head equipment of a user. As illustrated in FIG. 3, a user's protective helmet 229 fits within apparatus 225, such that a gap normally exists between the head plate 224 of the apparatus 225 and the protective helmet 229. This allows the user to freely move his/her head within the apparatus 225 during normal non-impact use. Further, the head plate 224 does not restrict the field of vision of the user because it extends adjacent the back cover 227 only upward and rearward about the periphery of the user's head. As clearly seen in FIG. 3 and depicted in FIGS. 1–5, this arrangement allows the field of view of a user to be structure-free and greater than a 180° field of view greater than 180.0 degrees includes any and all values greater than 180 degrees.

FIG. 3 also illustrates that a chest plate 228 of apparatus 225 may actually be shorter in length than an upper back plate 227. In this way, the apparatus 225 may be more easily fitted upon the user, thereby making the apparatus 225 easier to use for the user.

Figure 4A:
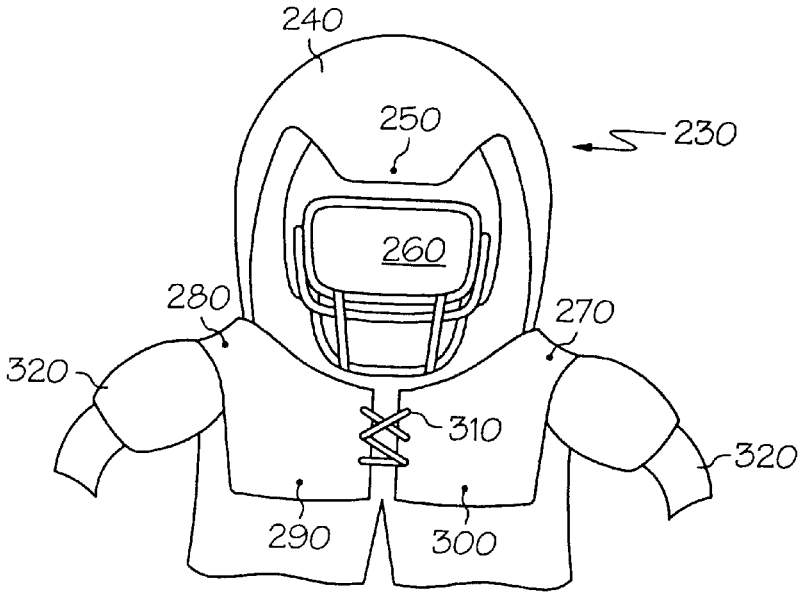
FIG. 4*a* depicts a neck and spine protection apparatus fitted about protective shoulder and head equipment of a user.

FIG. 4*a* depicts a neck and spine protection apparatus fitted about protective shoulder and head equipment of a user. Apparatus 230 is illustrated as it may appear on a user having a helmet 260 and protective shoulder gear 320. A right cover 280 may include covers that cover both the right breast, right shoulder, and right upper back of a user. Moreover, a left cover 270 may include covers that cover both the left breast, left shoulder, and left upper back of the user.

The right cover 280 may be attached to the left cover 270 in the front of the user using any attachment means, such as by way of example only, string 310 looped through holes in the covers. Although as one skilled in the art will readily appreciate however, the right cover 280 need not be attached to the left cover 270 at all as depicted in FIG. 4*b*.

Furthermore, the head cover 240 may be optionally attached to the helmet 260 of the use at an attachment point 250 on the head cover. Additionally, right cover 280 and left cover 270 may be attached to the protective shoulder equipment 320 of the user at attachment points 290 and 300, respectively. Moreover, although not depicted in FIG. 4*a*, additional attachment points may be located on the rear of the right cover 280 and the left cover 270 permitting the apparatus 230 to be attached to the protective shoulder equipment 320 on the upper back of the user.

Figure 4B:
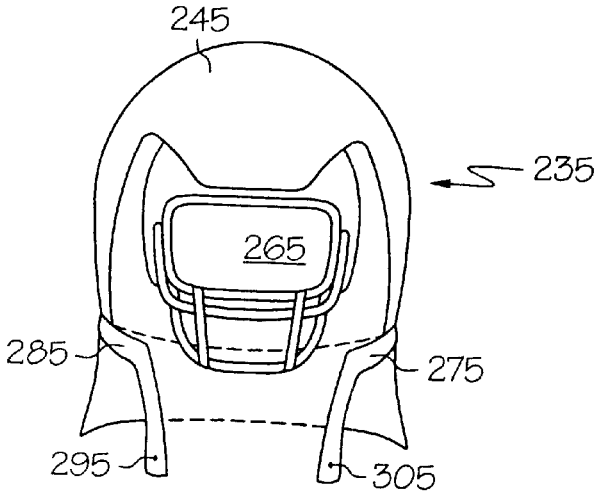
FIG. 4*b* depicts an alternative neck and spine protection apparatus fitted about protective shoulder and head equipment of a user.

FIG. 4*b* depicts an alternative neck and spine protection apparatus fitted about protective shoulder and head equipment of a user. Apparatus 235 includes a head cover 245 which is operable to cover a helmet 265 worn by a user. Moreover, a right cover 285 and a left cover 275 are tapered in the front of the chest of the user such that a gap exists between the covers. Further, attachment points 295 and 305 permit the apparatus 235 to be securely fastened to the protective shoulder equipment of a user, if desired.

Figure 5:
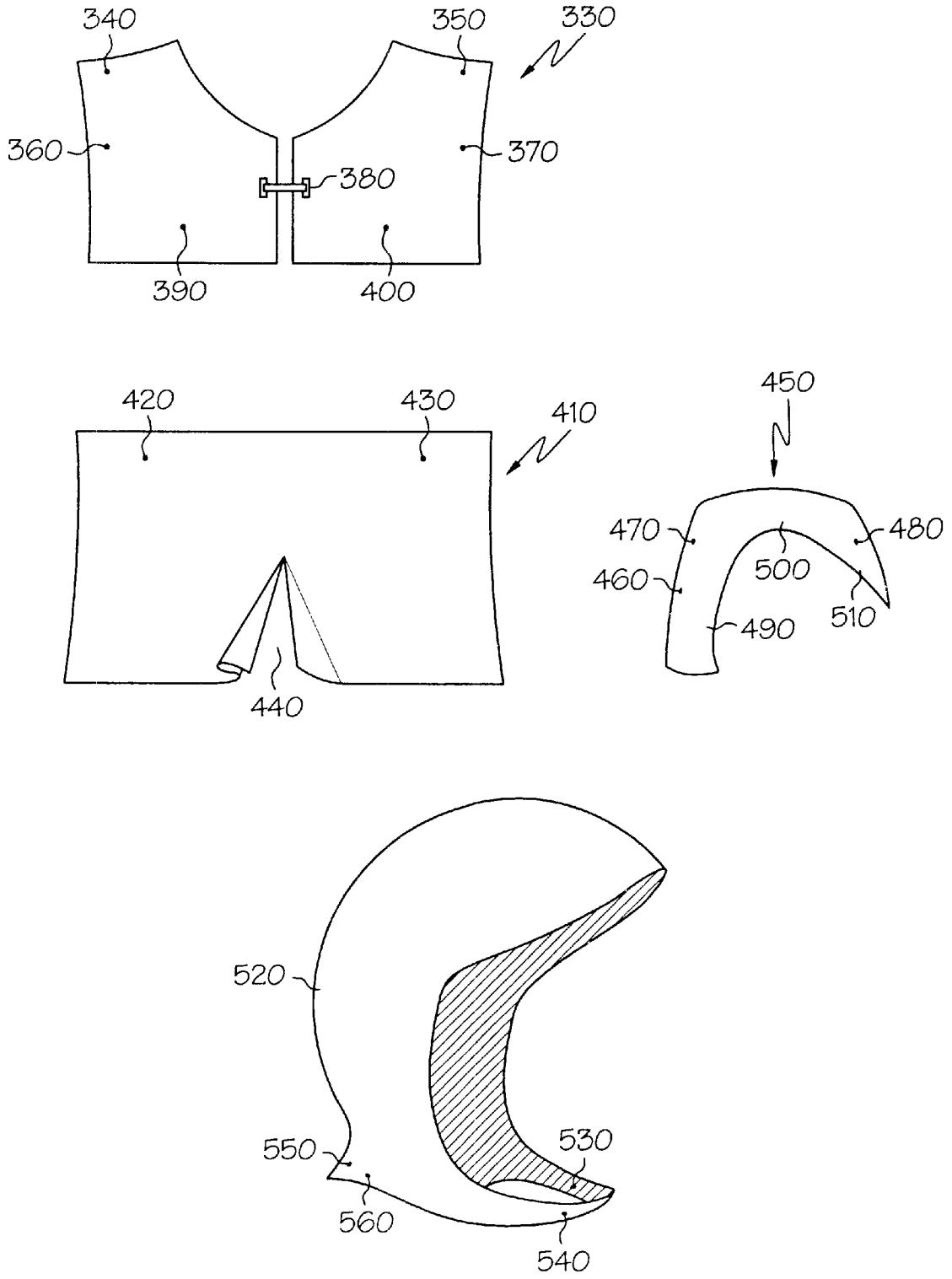
FIG. 5 depicts various segments and attachment points of a neck and spine protection apparatus of the present invention.

FIG. 5 depicts various segments and attachment points of a neck and spine protection apparatus of the present invention. As previously presented, the apparatus of the present invention may be deployed utilizing a variety of forms, such as integrating the apparatus as part of a user's shoulder protection equipment, or as a single stand alone apparatus which may be adapted to be securely fastened to a user's protective shoulder equipment, such as the apparatus of FIG.

1. Moreover, the apparatus may be secured in segments to itself or to the user such as and by way of example only, the various component segments depicted in FIG. 5.

For example, the chest cover 330 may be a single unit with attachment points 340,350, 390, and 400. These attachment points may be used to attach the chest cover 330 to protective shoulder equipment of the user and/or a head plate, such as 520 of the apparatus at points 530 and 540. Further, the chest cover 330 may include shoulder covers which extend to the back area of the user. Moreover, the chest cover 330 may be divided into two units 360 and 370 and attached to each other using string such as 380, or any other attachment means.

Additionally, a back cover 410 may have one or more attachment points 420 and 430 which permit the back cover to attach to a head cover such as head cover 520 at points 550 and 560. The back cover 410 may also include a gap, such as gap 440.

Alternatively, an apparatus of the present invention may be divided into halves, such as halve 450 wherein a front breast cover 510, a shoulder cover 500, and an upper back cover 490 are assembled as one unit and points 480 and 470 are operable to be attached to a head cover such as 520 using points 540 and 560, or points 530 and 550, as the case may be. In this way, the complete apparatus is assembled by attaching two halves together with a head cover.

As one skilled in the art will readily appreciate, a variety of configurations may be deployed without departing from the present invention. Moreover, these configurations may be adapted to integrate with equipment already worn by a user such as head and shoulder equipment.

The foregoing description of an exemplary embodiment of the invention has been present for purposes of illustration and description. It is not intended to be exhaustive nor to limit the invention to the precise form disclosed. Many alternatives, modifications, and variations will be apparent to those skilled in the art in light of the above teaching. Accordingly, this invention is intended to embrace all alternatives, modifications, and variations that fall within the spirit and broad scope of the attached claims.

What is claimed is:

1. A neck and spinal protection apparatus, comprising:

a chest cover for fitting about a chest of a user;

a back cover for fitting about an upper back of a user;

a shoulder cover for fitting about the user's shoulders and connected to the chest and back covers; and a head cover for fitting over a head of the user and connected to the back cover, wherein the head cover extends only about the upward and rearward periphery of a user and disperses a force associated with an impact to the head cover downward to the chest, back and shoulder covers in use.

2. The apparatus of claim 1, wherein the chest cover includes right and left portions which are vertically separated along a center of the user's chest.

3. The apparatus of claim 2, wherein the chest cover is operable to be opened using the right and left portions and placed onto the user.

4. The apparatus of claim 3, wherein the right and left portions are operable to be securely fastened together when placed onto the user.

5. The apparatus of claim 1, wherein the shoulder cover is operable to fit over a protective shoulder equipment.

6. The apparatus of claim 5, wherein the shoulder cover fits over the protective shoulder equipment leaving a recess above the protective shoulder equipment.

7. The apparatus of claim 6, wherein the chest cover and the back cover are operable to be securely fastened to the protective shoulder equipment.

8. The apparatus of claim 1, wherein the head cover is operable to fit over a protective helmet of the user.

9. The apparatus of claim 1, wherein the head cover is operable to be securely fastened to the protective helmet.

10. A neck and spinal protection apparatus, comprising:

an upper torso cover which fits about a chest, an upper back and shoulders of a user; and a neck and head cover attached to the back of the upper torso cover and having a structure-free field of view for the user, the neck and head cover further fitting about a rear portion of the user's neck and head and dispersing a force to the head or neck of the user downward to the upper torso cover in use.

11. The apparatus of claim 10, wherein the neck and head cover is detachable from the upper torso cover.

12. The apparatus of claim 10, which is made of polycarbonate lexan material.

13. The apparatus of claim 10, wherein the upper torso cover fits over a protective shoulder equipment operable to be placed over the user's shoulders.

14. The apparatus of claim 13, wherein the upper torso cover is operable to securely fastened to the protective shoulder equipment.

15. The apparatus of claim 10, wherein the neck and head cover is operable to not restrict the user's range of vision.

16. The apparatus of claim 10, wherein the upper torso cover is operable to be split along a front portion and opened outwardly permitting the user place the apparatus over the user's head, neck, back and chest.

17. A neck and spinal protection apparatus, comprising:

a right breast, shoulder, and upper back plate operable to be fitted about a user's right breast, shoulder and upper back;

a left breast, shoulder, and upper back plate operable to be fitted about a user's left breast, shoulder, and upper back; and a head plate providing a user with greater than a 180° field of view, fitting about the periphery of a user's head in use, and fastening securely to the right and left upper back plates.

18. The apparatus of claim 17, wherein the left and right plates are operable to be placed over and securely fasten to a protective shoulder equipment worn by the user.

19. The apparatus of claim 17, wherein the head plate is operable to be placed over and securely fastened to a protective helmet worn by the user.

20. The apparatus of claim 19 wherein the head plate is securely fastened to the protective helmet by snapping onto the helmet.

* * * * *

UNITED STATES PATENT AND TRADEMARK OFFICE

CERTIFICATE OF CORRECTION

PATENT NO. : 6,434,756 B1
DATED : August 20, 2002
INVENTOR(S) : Vohn Hoop

It is certified that error appears in the above-identified patent and that said Letters Patent is hereby corrected as shown below:

Column 8,
Line 32, after "operable to" add -- be --.
Line 38, after "user" add -- to --.
Line 53, change "fasten" to -- fastened --.

Signed and Sealed this

Fifth Day of November, 2002

*Attest:*

*Attesting Officer*

JAMES E. ROGAN
*Director of the United States Patent and Trademark Office*